US009022383B2

(12) United States Patent
Huang et al.

(10) Patent No.: US 9,022,383 B2
(45) Date of Patent: May 5, 2015

(54) PAPER SHEET STACKING AND RECYCLING DEVICE AND PAPER SHEET PROCESSING APPARATUS HAVING SAME

(75) Inventors: Shaohai Huang, Guangzhou (CN); Dongbo Liu, Guangzhou (CN)

(73) Assignee: GRG Banking Equipment Co., Ltd., Guangzhou (CN)

( * ) Notice: Subject to any disclaimer, the term of this patent is extended or adjusted under 35 U.S.C. 154(b) by 0 days.

(21) Appl. No.: 13/882,992

(22) PCT Filed: Jul. 10, 2012

(86) PCT No.: PCT/CN2012/078402

§ 371 (c)(1),
(2), (4) Date: May 2, 2013

(87) PCT Pub. No.: WO2013/034026

PCT Pub. Date: Mar. 14, 2013

(65) Prior Publication Data

US 2014/0175733 A1 Jun. 26, 2014

(30) Foreign Application Priority Data

Sep. 8, 2011 (CN) ..... 2011 1 0265861

(51) Int. Cl.
*B65H 29/14* (2006.01)
*B65H 31/00* (2006.01)
(Continued)

(52) U.S. Cl.
CPC ..... *B65H 31/00* (2013.01); *G07D 11/0021* (2013.01); *B65H 29/145* (2013.01);
(Continued)

(58) Field of Classification Search
CPC ..... B65H 29/145; B65H 31/3027
USPC ..... 271/69, 198, 902, 225
See application file for complete search history.

(56) References Cited

U.S. PATENT DOCUMENTS 4,363,584 A * 12/1982 Kokubo ..... 414/788.5
5,330,316 A * 7/1994 Buckman et al. ..... 414/790.2
(Continued)

FOREIGN PATENT DOCUMENTS

CN 1130147 A 9/1996
CN 2747641 Y 12/2005
(Continued)

OTHER PUBLICATIONS

European Search Report issued on Jan. 5, 2015 regarding a European counterpart application 12829653.0.

*Primary Examiner* — Luis A Gonzalez
(74) *Attorney, Agent, or Firm* — Kilpatrick Townsend & Stockton LLP

(57) ABSTRACT

A paper sheet stacking and recycling device (5) and a paper sheet processing apparatus having same. The device comprises: a paper sheet conveying and stacking mechanism (51), located in front of a paper sheet discharging port and used for conveying the discharged paper sheets to a preset position one by one and stacking; a paper sheet discharging mechanism, located at the front end of the paper sheet conveying and stacking mechanism and used for discharging the stacked paper sheets in stack; and a paper sheet recycling mechanism (52), located at the front end of a paper sheet storage container (23) and used for recycling the stacked paper sheets in stack. A paper sheet processing apparatus having the foregoing device is capable of avoiding secondary separation of single paper sheets and more deflection after the paper sheets pass through a device for tilt correction and the like, so as to reduce the occurrence probability of faults such as blocking.

16 Claims, 7 Drawing Sheets

(51) Int. Cl.

| | |
|---|---|
| ***G07D 11/00*** | (2006.01) |
| ***B65H 31/30*** | (2006.01) |
| ***B65H 3/04*** | (2006.01) |
| ***B65H 3/06*** | (2006.01) |
| ***B65H 5/02*** | (2006.01) |
| ***B65H 9/04*** | (2006.01) |

(52) U.S. Cl.

CPC .. *B65H31/3027* (2013.01); *B65H 2301/42124* (2013.01); *B65H 2301/4213* (2013.01); *B65H 2701/1912* (2013.01); *B65H 3/04* (2013.01); *B65H 3/06* (2013.01); *B65H 5/021* (2013.01); *B65H 9/04* (2013.01); *G07D 11/0018* (2013.01); *Y10S 271/902* (2013.01)

(56) References Cited

U.S. PATENT DOCUMENTS

| | | | | | |
|---|---|---|---|---|---|
| 5,718,426 | A * | 2/1998 | Youn | ..... | 271/225 |
| 5,850,075 | A * | 12/1998 | Brannan et al. | ..... | 235/379 |
| 6,386,445 | B2 * | 5/2002 | Imai et al. | ..... | 235/379 |
| 8,267,398 | B2 * | 9/2012 | Takada et al. | ..... | 271/198 |
| 2003/0007823 | A1 * | 1/2003 | Tsuchiya et al. | ..... | 400/617 |
| 2005/0056694 | A1 * | 3/2005 | Kako et al. | ..... | 235/379 |

FOREIGN PATENT DOCUMENTS

| | | | |
|---|---|---|---|
| CN | 101211480 | A | 7/2008 |
| CN | 101249910 | A | 8/2008 |
| CN | 101804923 | A | 8/2010 |
| CN | 102087765 | A | 6/2011 |
| CN | 102324138 | A | 1/2012 |
| EP | 0793197 | A2 | 9/1997 |
| EP | 1736937 | A1 | 12/2006 |
| EP | 1926057 | A1 | 5/2008 |
| JP | 1177189 | A | 7/1989 |
| JP | 11219468 | A | 8/1999 |
| JP | 2001043417 | A | 2/2001 |
| JP | 101625780 | A | 1/2010 |
| KR | 100618273 | B1 | 9/2006 |

* cited by examiner

PAPER SHEET STACKING AND RECYCLING DEVICE AND PAPER SHEET PROCESSING APPARATUS HAVING SAME

This application is the national phase of International Application No. PCT/CN2012/078402, titled "PAPER SHEET STACKING AND RECYCLING DEVICE AND PAPER SHEET PROCESSING APPARATUS HAVING SAME", filed on Jul. 10, 2012 which claims the benefit of priority to Chinese Patent Application No. 201110265861.9 titled "PAPER-LIKE MEDIUM STACKING AND RECYCLING DEVICE AND PAPER-LIKE MEDIUM PROCESSING APPARATUS WITH THE SAME", filed with the Chinese State Intellectual Property Office on Sep. 8, 2011, the entire disclosures of which is are incorporated herein by reference.

FIELD OF THE INVENTION

The present application relates to a paper processing device which can align ends of paper-like mediums, such as paper moneys, that are conveyed in the longitudinal direction in one direction, stack the paper-like mediums onto a predetermined stacking plate, and deliver and recycle the whole stack of paper-like mediums, and relates to an apparatus having the paper processing device.

BACKGROUND OF THE INVENTION

The prior paper-like medium processing apparatus (such as the Automatic Teller Machine) returns the paper money rejected or can not be identified to the user immediately. In the case that the user forgets to take away the paper money, the prior art mainly provides two solutions: according to the first solution, a sensor is provided at the outlet for the returned banknote such that the machine is stopped where an error is detected, thereby it requires the maintenance personnel to maintain and clean up the machine; according to the second solution, ends of the paper moneys are aligned, then the paper moneys are stacked to a predetermined stacking plate. The stack of paper moneys is conveyed to the single-sheet separating device, such that the paper moneys are separated in the single-sheet form again, then the paper moneys are conveyed, one by one, to the correcting device, the paper scanning device and the like again, finally the paper moneys are conveyed to the predetermined cash box and are stacked and stored therein.

According to the first solution, in the case that the user forgets to take away the banknotes, the apparatus will be stopped and will not provide any service until it is cleaned up by the maintenance personnel, which will inevitably affect the utilization ratio of the apparatus, especially at night or on holidays. According to the second solution, during the recycling process, the paper moneys undergo the single-sheet separating process again, and are conveyed to the correcting device, the paper scanning device and the like, and then are conveyed to the predetermined cash box and are stacked and stored therein again, which increases the utilization frequencies of some devices in the apparatus. Besides, some paper moneys are returned because they are tilted at a large angle and thus can not be identified. It is possible that the tilted angles of the paper moneys become larger after another single-sheet separating process. Thereby the possibility that the apparatus is jammed by the paper moneys is increased.

In the two solutions described above, the banknotes are stacked under the driving force of the driving rollers. After the banknotes leave the driving rollers, they can only rely on the frictions between the first driving belt and the banknotes to overcome the frictions between the banknotes and the lower passage wall to move towards the banknote outlet. Although the lower passage wall may be machined to be smooth, the conveying force for the stack of the banknotes is still insufficient.

SUMMARY OF THE INVENTION

In view of this, an object of the present application is to provide a device which can align ends of paper-like mediums, such as paper moneys, conveyed in the longitudinal direction in one direction and stack the paper-like mediums, delivering the whole stack of paper-like mediums, and recycle the whole stack of paper-like mediums along a simple route, and to provide a paper-like medium processing apparatus having the device, to thereby effectively reduce the probability of failure of the paper-like medium processing apparatus.

To solve the above technical problems, it is provided according to the present application a paper-like medium stacking and recycling device including: a paper conveying and stacking mechanism located in front of a paper discharging port and configured to convey discharged paper, one by one, to a predetermined position and stack the paper; a paper delivering mechanism located at a front end of the paper conveying and stacking mechanism and configured to deliver the whole stack of paper outside; and a paper recycling mechanism located at a front end of a paper storing container and configured to recycle the whole stack of paper.

Preferably, the paper discharging port is formed by an upper convey-out conveying belt and a lower convey-out conveying belt, a guiding plate is provided in front of the paper discharging port in an advancing direction of the paper; and the paper conveying and stacking mechanism is located in front of the guiding plate.

Preferably, the paper conveying and stacking mechanism includes a first conveying belt assembly and a movable blocking mechanism, wherein a first conveying belt of the first conveying belt assembly is provided in parallel with a conveyed direction of the paper, the movable blocking mechanism is provided in the conveyed direction of the paper and can be closed during the stacking of the paper and be opened during the delivering of the paper; the paper delivering mechanism includes a second conveying belt assembly under the first conveying belt assembly, with a paper delivering outlet being formed between a front end of a second conveying belt of the second conveying belt assembly and a front end of the first conveying belt; and the paper recycling mechanism includes a third conveying belt assembly located behind the second conveying belt assembly, with a paper recycling port corresponding to an inlet of the paper storing container being formed between a front end of a third conveying belt of the third conveying belt assembly and a back end of the second conveying belt, a direction switching device is provided above the paper recycling port, the direction switching device being configured for closing the paper recycling port during the stacking and delivering of the paper and opening the paper recycling port during the recycling of the paper.

Preferably, the paper conveying and stacking mechanism includes an arc-shaped plate located right under the first conveying belt, and a lower segment of the first conveyer belt is tensioned and is in contact with the upper arc surface of the arc-shaped plate.

Preferably, the arc-shaped plate includes a front arc-shaped plate and a back arc-shaped plate, wherein a curvature of the front arc-shaped plate is substantially equal to that of the back arc-shaped plate, and a surface at a back end of the back arc-shaped plate is lower than the paper discharging outlet.

Preferably, the paper recycling port is located under an interspace between the front arc-shaped plate and the back arc-shaped plate, and the direction switching device is pivotally mounted on a spindle which is located at a rear side of the paper recycling port.

Preferably, a top surface of the direction switching device is an arc surface having a curvature substantially equal to that of the front arc-shaped plate and that of the back arc-shaped plate, and the top surface of the direction switching device is continuous with an upper arc surface of the front arc-shaped plate and an upper arc surface of the back arc-shaped plate where the direction switching device is in a closed state closing the paper recycling port.

Preferably, a recycling floating mechanism is provided at the back end of the second conveying belt assembly, wherein the recycling floating mechanism includes: a recycling floating bracket which can swing about a recycling floating bracket spindle, and a recycling floating roller provided at a tail end of the recycling floating bracket, and the second conveying belt is engaged on the recycling floating roller.

Preferably, a delivering floating mechanism is provided at the front end of the second conveying belt assembly, wherein the delivering floating mechanism includes: a delivering floating bracket which can swing about a delivering floating bracket spindle, a delivering floating roller assembly provided on the delivering floating bracket, and the second conveying belt is engaged on the delivering floating roller assembly such that a working surface of the second conveying belt can be lower than the upper arc surface of the front arc-shaped plate during the stacking of the paper, and can be higher than the upper arc surface of the front arc-shaped plate during the delivering and recycling of the paper.

Preferably, a fourth conveying belt assembly is provided at the front end of the third conveying belt assembly, and an upper conveying surface of the fourth conveying belt assembly is partially in contact with a lower conveying surface of the first conveying belt assembly.

Preferably, a pressing plate which can swing about a pressing plate spindle is provided at the paper delivering outlet, a first pressing roller is provided on the pressing plate, and the first conveying belt is engaged on the first pressing roller.

Preferably, a second pressing roller is provided on the second conveying belt assembly at a position corresponding to the first pressing roller, and the second conveying belt is engaged on the second pressing roller.

Preferably, the movable blocking mechanism is a movable baffle located in the advancing direction of the paper and pivotally mounted on a movable baffle spindle.

Preferably, a control system is provided, which includes:

an collection module including: a first sensor device located between a convey-out roller at the paper discharging port and the driving roller of the first conveying belt assembly, for detecting paper condition to be conveyed to the back end of the first conveying belt assembly; and a second sensor device located in front of the movable blocking mechanism, for detecting paper condition remained at the paper delivering outlet;

a processing module configured to receive a detection signal from the collection module, perform processing according to a preset strategy, and output a corresponding control signal; and an execution module configured to drive the first conveying belt assembly, the second conveying belt assembly, the third conveying belt assembly, the movable blocking mechanism and the direction switching device according to the corresponding control Based on the above solutions, it is further provided according to the present application a paper-like medium processing apparatus including a single-sheet separating device, a paper correcting device, a paper identifying device, a temporary storing device, a paper storing box, and the above paper-like medium stacking and recycling device. The paper-like stacking and recycling device is provided downstream of the temporary storing device.

Compared with the prior art, the device according to the present application can align ends of the paper in one direction and stack the paper, deliver the whole stack of paper, and recycle the whole stack of paper, to prevent the paper from being tilted at larger angle after suffering another single-sheet separating process and being processed by the correcting device again, thereby the probability of failure of machine, such as being jammed by the paper, is reduced.

According to the present application, the fourth conveying belt assembly is provided at the front end of the third conveying belt assembly, and the upper conveying surface of the fourth conveying belt assembly is partially in contact with the lower conveying surface of the first conveying belt assembly, which can provide subsequent driving force for the banknotes to be stacked, thereby the success ratio of the stacking of the banknotes is improved.

DETAILED DESCRIPTION

Figure 1:
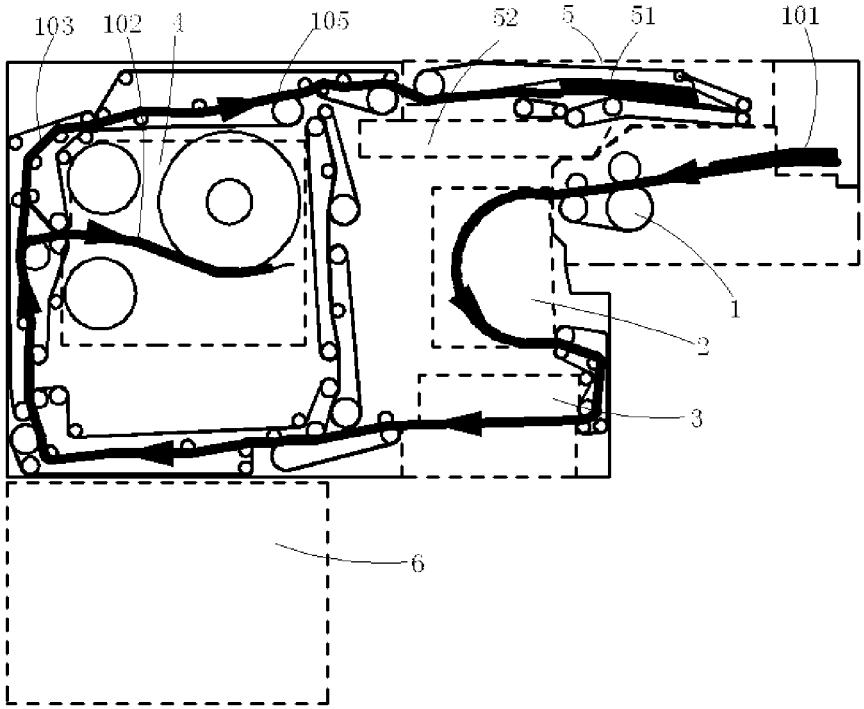
FIG. 1 is a frame diagram showing a flow from the separating of the banknotes to the temporary storing of the banknotes of a cash deposit machine.

A paper-like medium stacking and recycling device according to a preferred embodiment of the present application includes: a paper conveying and stacking mechanism configured to convey paper, in a single-sheet form, to a predetermined position and stack the paper; a paper delivering mechanism configured to deliver the whole stack of paper to the paper outlet, the paper delivering mechanism is located at the back end of the paper conveying and stacking mechanism; and a paper recycling mechanism configured to recycle the whole stack of paper, the paper recycling mechanism is located at the front end of a predetermined storing container. The structures and functions of the mechanisms are as follows:

1. The paper conveying and stacking mechanism: an upper conveying belt is engaged on a drive shaft and a driven shaft which are arranged in the conveying direction, and the driven shaft is provided on a movable pressing plate. An arc-shaped plate is provided right under the upper conveying belt, and the upper conveying belt is tensioned and is in contact with the arc surface of the arc-shaped plate such that the arc surface suffers an evenly distributed positive pressure, to thereby increase the conveying force of the conveying belt on the paper. A movable blocking mechanism is provided in the conveyed direction of the paper, which is configured to prevent the paper from moving forward during the stacking process and to open a passage for the paper during the delivering of the paper.

2. The paper delivering mechanism: a movable delivering tensioning mechanism is provided under the front end of the arc-shaped plate, and the movable delivering tensioning mechanism and the movable blocking mechanism are driven by the same power. The movable delivering tensioning mechanism is provided with a transmission shaft, and a lower conveying belt is engaged on the transmission shaft. During the stacking process, the movable delivering tensioning mechanism is swung downwardly such that the lower conveying belt is lower than the arc surface of the arc-shaped plate, and the paper can not contact the conveying belt. During the delivering process after the stacking process of the paper, the movable blocking mechanism is swung at an angle to allow the paper being conveyed forward. Meanwhile the movable delivering tensioning mechanism is swung upwardly at an angle such that the lower conveying belt is higher than the arc surface of the arc-shaped plate. Thereby the whole stack of paper is clamped by the upper conveying belt and the lower conveying belt and is delivered outside. The stack of paper is delivered outside to a distance such that the tail end of the stack of paper is clamped by the driven shaft of the movable pressing plate provided with the upper conveying belt and the lower conveying belt.

3. The paper recycling mechanism: a direction switching device and a recycling movable tensioning mechanism are provided in the recycled direction of the paper. The recycling movable tensioning mechanism is provided with a recycling drive shaft, the recycling drive shaft is provided with a lower conveying belt, and a recycling conveying belt is provided at a position corresponding to the lower conveying belt. Where the motor is rotated reversely, the whole stack of paper is conveyed from a stacking and delivering unit to a recycling unit, and the recycling unit can automatically adapt itself to the total thickness of the stacked paper and convey the staked papers to a predetermined storing container.

Hereinafter, the technical solutions in a cash deposit machine according to an embodiment of the present application will be described clearly and completely in conjunction with the drawings in the embodiment of the present application, by taking the banknote as an example.

Referring to FIG. 1 which shows a flow from the separating of the banknotes to the temporary storing of the banknotes of the cash deposit machine. The cash deposit machine has a deposit port 101, a single-sheet separating device 1, a paper correcting device 2, a paper identifying device 3, a temporary storing device 4, a stacking and recycling device 5, and a storing box 6. The single-sheet separating device 1 is configured to separate the banknotes at the deposit port 101 one by one and convey the banknotes forward. The paper correcting device 2 is configured to correct the banknote tilted with respect to the advancing direction of the banknotes such that the banknote is aligned with a reference plane parallel to the advancing direction. The paper identifying device 3 is configured to identify the authenticity, the denomination, the positive or negative surface, and the intactness or damage of the banknote or the cheque, detect whether there is abnormal conveying circumstance, such as tilted movement, overlapping or continuation of the paper, and determine whether the paper can be stored. The temporary storing device 4 is configured to temporarily store the banknote or the cheque detected to be normally conveyed and can be identified. The stacking and recycling device is configured to stack and deliver returned banknotes or cheques, and recycle those left by the user. The detailed operation process is: a user places a single sheet of banknote or a plurality sheets of banknotes at the deposit port 101 where depositing, the banknote is separated, in a single-sheet form, by the single-sheet separating unit 1, and is conveyed through the paper correcting device 2 and the paper identifying device 3 in turn, then the banknote is conveyed into the temporary storing device 4 via the route 102 in cases that the banknote is detected to be normally conveyed and the denomination of it can be identified or the cheque can be identified. In a case that the banknote or cheque can not be identified, it will be returned to the stacking and recycling device 5 via routes 103 and 105, and be aligned and stacked on the stacking unit 51. After all the banknotes at the deposit port 101 are separated, the stack of returned banknotes is delivered to the deposit port. Where it is determined that the user does not take away the returned banknotes or cheques within a set time, the banknotes or cheques will be recycled to the recycling unit 52.

Figure 2:
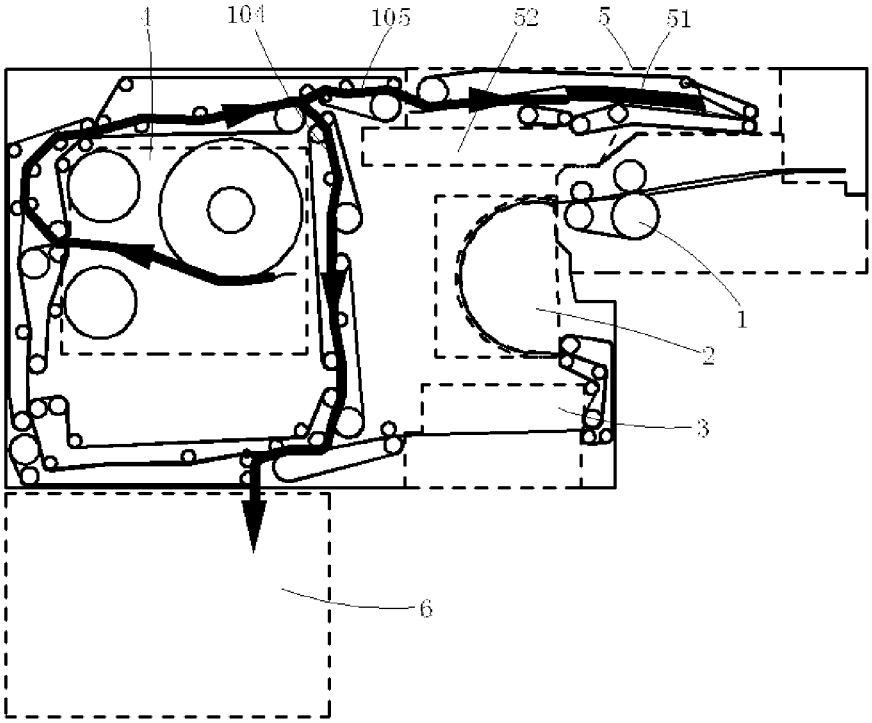
FIG. 2 is a frame diagram showing a banknote depositing flow and a banknote returning flow of a cash deposit machine.

Referring to FIG. 2 which shows a banknote depositing flow and a banknote returning flow of the cash deposit machine. As shown in FIG. 2, after the single-sheet separating of the banknotes is finished, it is to be confirmed, by the user, whether to deposit the banknotes stored in the temporary storing unit 4, i.e. the banknotes detected to be normally conveyed and the denomination of which are identified: if the user confirms to deposit the banknotes, the banknotes are conveyed from the temporary storing device 4 to the storing container 6 via the route 104, thereby the banknote depositing process is performed; if the user decides to cancel the depositing of the banknotes, the banknotes are conveyed from the temporary storing device 4 to the stacking and recycling device 5 via the route 105, such that the banknotes are aligned and stacked on the stacking unit 51, and the whole stack of banknotes are then delivered outside, thereby the banknote returning process is performed. Where it is determined that the user does not take away the returned banknotes within a set time, the banknotes will be recycled to the recycling unit 52.

Referring to FIG. 3 to FIG. 17 which show structures of a paper-like medium stacking and recycling device (referred to as a stacking and recycling device hereinafter) according to the present application, and the structures will be described in detail hereinafter.

Figure 3:
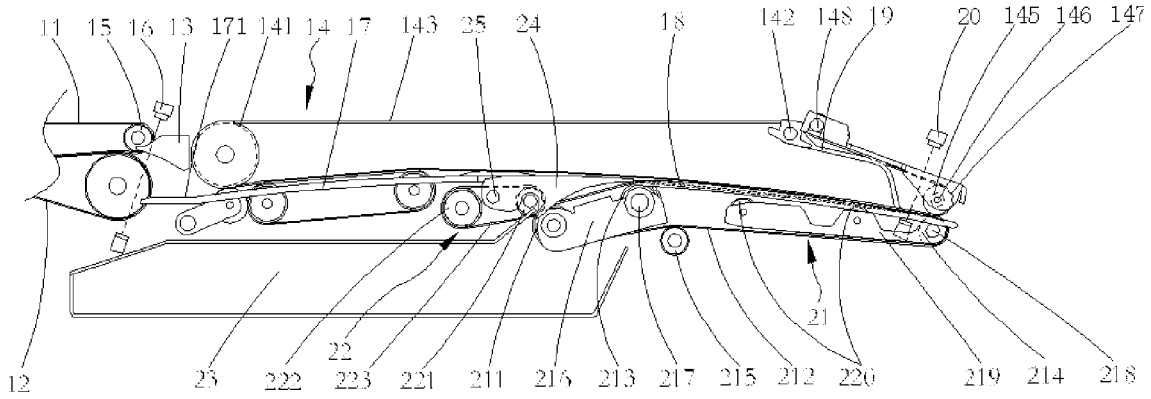
FIG. 3 is a side view showing a first state of a paper-like medium stacking and recycling device according to the present application, in which a movable baffle is in a closed state and a direction switching device is in a first position.
Figure 4:
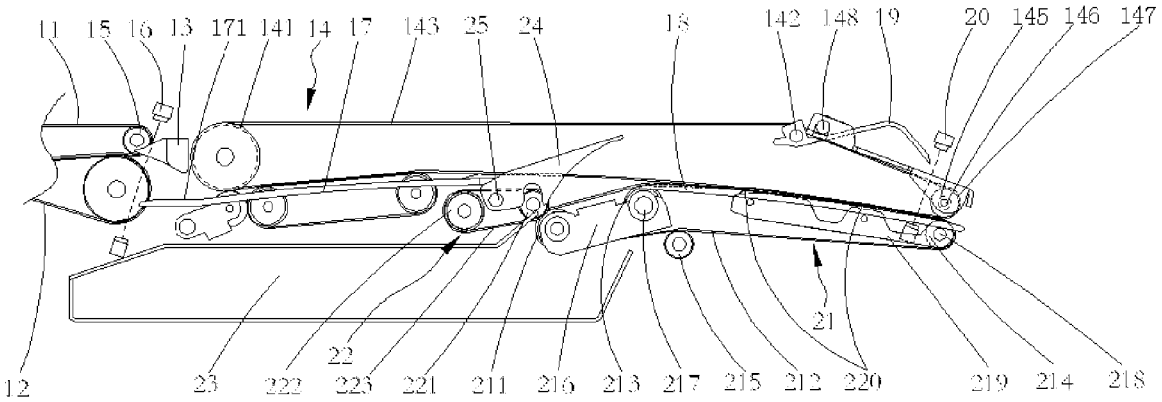
FIG. 4 is a side view showing a second state of the paper-like medium stacking and recycling device according to the present application, in which the movable baffle is in an opened state and the direction switching device is in a second position.
Figure 5:
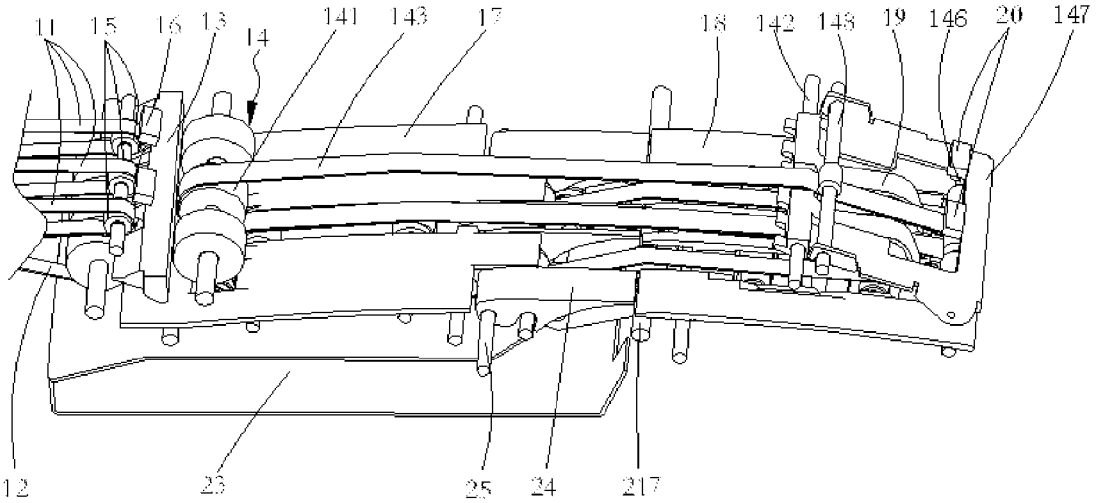
FIG. 5 is an axonometric drawing of the paper-like medium stacking and recycling device according to the present application.

As shown in FIGS. 3 and 4 which are side views of the stacking and recycling device according to the present application. Banknotes returned via the route 105 are clamped by the upper convey-out conveying belt 11 and the lower convey-out conveying belt 12 and are conveyed, one by one, to the stacking and recycling device 5. A guiding plate 13 is provided in the advancing direction of the discharged banknotes. A first conveying belt assembly 14 arranged parallel to the advancing direction (i.e., the right side of the guiding plate shown in the Figures) of the banknotes is provided in front of the guiding plate 13. A first sensor device 16 is provided between the driving roller 141 of the first conveying belt assembly 14 and the convey-out roller 15, for detecting each discharged banknote. A back arc-shaped plate 17 and a front arc-shaped plate 18, the curvatures of which are equal, are provided under the first conveying belt assembly 14. The plane 171 at the back end of the back arc-shaped plate 17 is lower than the output (the paper discharging port) formed by the upper convey-out conveying belt 11 and the lower convey-out conveying belt 12. A movable baffle 19 pivotally mounted on a spindle 142 is located above the front segment of the front arc-shaped plate 18, and the movable baffle 19 can be in two operation states: one is the opened state as shown in FIG. 4, the other is the closed state as shown in FIG. 3. A second sensor device 20 is fixedly provided in front of the movable baffle 19, and the second sensor device 20 can detect the existence of the banknote located in front of the movable baffle 19 and above the front arc-shaped plate 18. A second conveying belt assembly 21 that is adjustable is provided under the front arc-shaped plate 18, and a third conveying belt assembly 22 is provided at a position corresponding to the back segment of the second conveying belt assembly 21. Preferably, the first conveying belt assembly 14, the second conveying belt assembly 21 and the third conveying belt assembly 22 may be driven by the same power. A storing container 23 is provided under the recycling unit 52, and the inlet of the storing container 23 corresponds to the conveying port formed by the recycling floating roller 211 of the second conveying belt assembly 21 and the driven roller 221 of the third conveying belt assembly 22. A direction switching device 24 pivotally mounted on the spindle 25 is located between the back arc-shaped plate 17 and the front arc-shaped plate 18 and above the conveying port formed by the recycling floating roller 211 and the driven roller 221, and the direction switching device 24 can be in two operation states, as shown in FIG. 3 and FIG. 4 showing a first position and a second position of the direction switching device 24, respectively.

Figure 6:
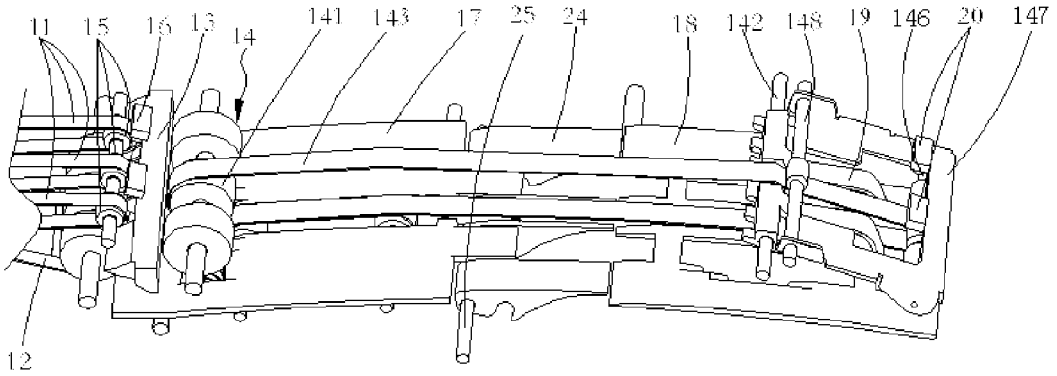
FIG. 6 is an axonometric drawing of an upper portion of the paper-like medium stacking and recycling device according to the present application.
Figure 9:
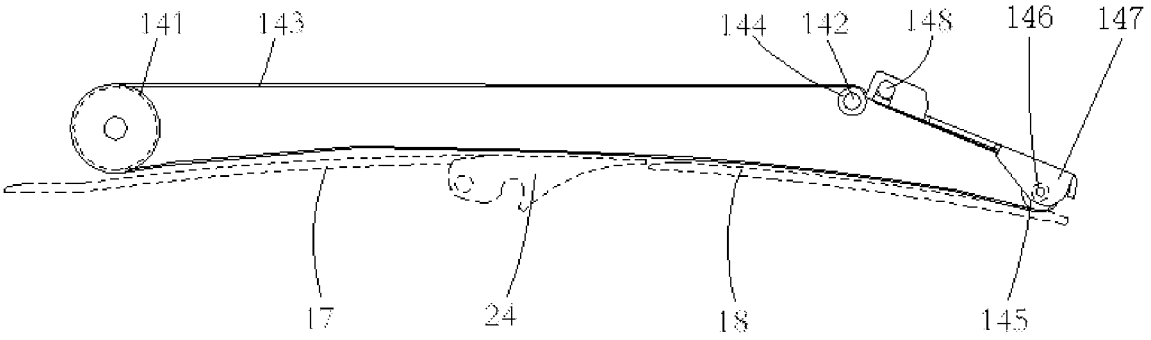
FIG. 9 is a side view of a first conveying belt assembly.
Figure 10:
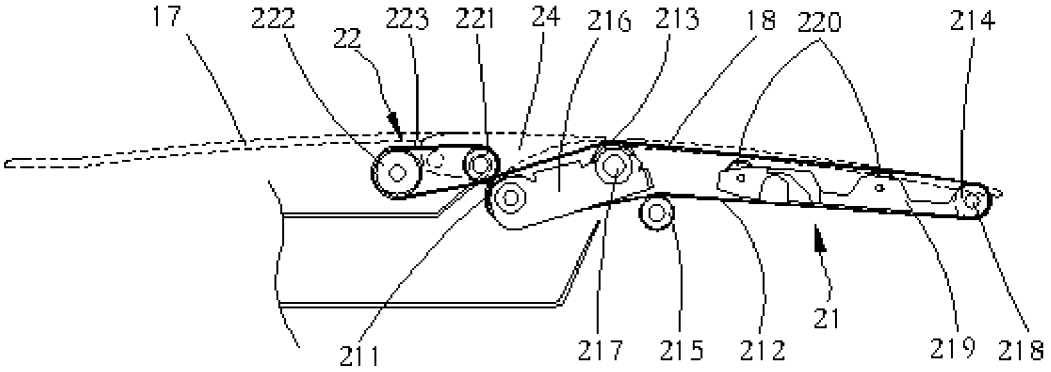
FIG. 10 is a side view of the second conveying belt assembly and the third conveying belt assembly, with a floating bracket being in a first position.
Figure 11:
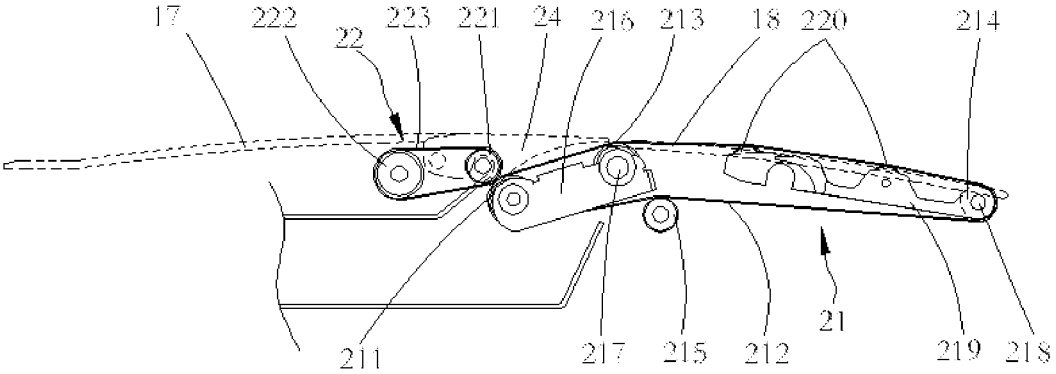
FIG. 11 is a side view of the second conveying belt assembly and the third conveying belt assembly with the floating bracket being in a second position.

As shown in FIG. 6 and FIG. 9, the first conveying belt (the upper conveying belt) 143 of the first conveying belt assembly 14 is engaged on the driving roller 141, the roller 144 and the pressing roller 145. The lower segment of the first conveying belt 143 is tensioned and is in contact with the upper surface of the back arc-shaped plate 17 and the upper surface of the front arc-shaped plate 18. The pressing roller 145 is fixedly connected to the front end of the pressing plate 147 via the spindle 146, and the pressing plate 147 can swing about the spindle 148.

Figure 7:
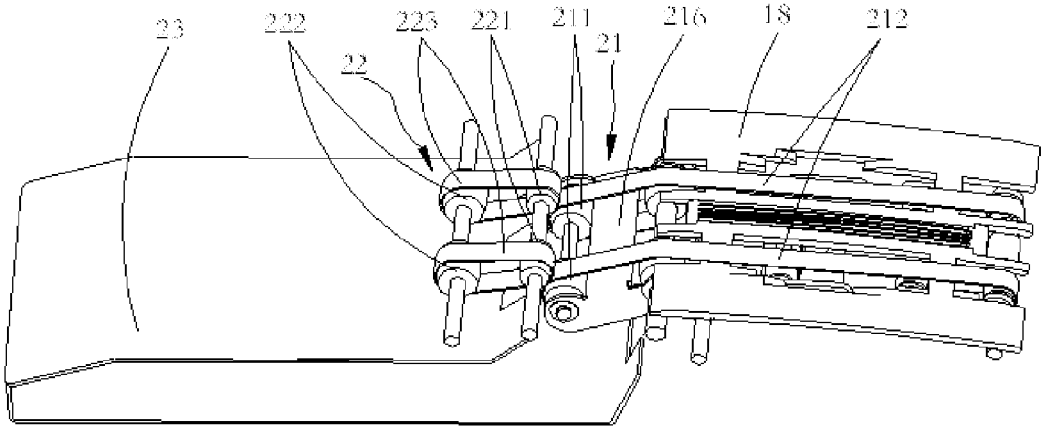
FIG. 7 is an axonometric drawing of a lower portion of the paper-like medium stacking and recycling device according to the present application.
Figure 8:
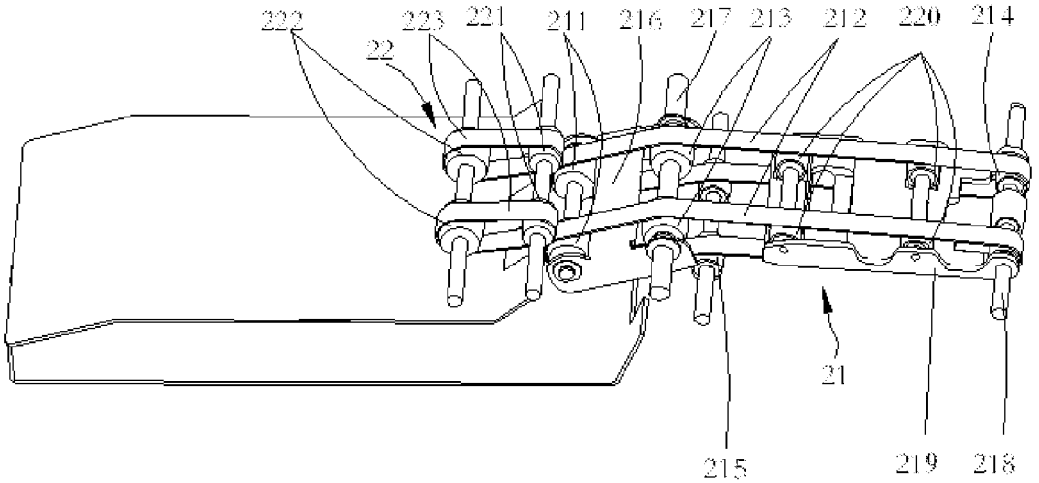
FIG. 8 is an axonometric drawing of a second conveying belt assembly and a third conveying belt assembly, with a front arc-shaped plate being removed.

As shown in FIG. 7, FIG. 8, FIG. 10 and FIG. 11, two side-by-side second conveying belts (the lower conveying belts) 212 of the second conveying belt assembly 21 are engaged on the recycling floating roller 211, the second driving roller 213, the second pressing roller 214 and the tension roller 215. The second pressing roller 214 is located corresponding to the pressing roller 145 of the first conveying belt assembly 14. The recycling floating rollers 211 are mounted on the recycling floating bracket 216 via a pair of bearings, and the recycling floating bracket 216 can swing about the spindle 217. The banknote delivering floating bracket 219 which can swing about the spindle 218 is provided at the front end of the second conveying belt assembly 21, and the banknote delivering floating bracket 219 can be in two operation states: FIG. 7 and FIG. 8 show a first position and a second position of the banknote delivering floating bracket 219, respectively. The banknote delivering floating bracket 219 and the movable baffle 19 are driven by the same power. The banknote delivering floating bracket 219 is provided with two rows of roller assemblies 220 corresponding to the second conveying belts 212, the roller assemblies 220 can make the working surfaces of the second conveying belts 212 to be higher or lower than the upper arc surface of the front arc-shaped plate 18 by means of the swinging of the banknote delivering floating bracket 219. The third conveying belts 223 of the third conveying belt assembly 22 are engaged on the third driving rollers 222 and the driven rollers 221.

Figure 12:
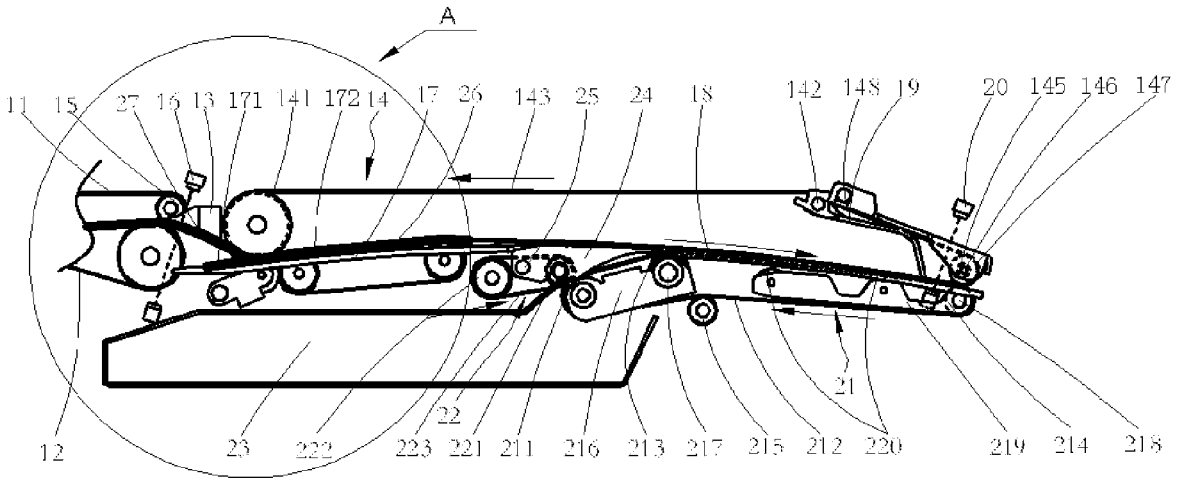
FIG. 12 is a flow diagram of the paper-like medium stacking and recycling device according to the present application during the conveying process of a first banknote and a second banknote.
Figure 13:
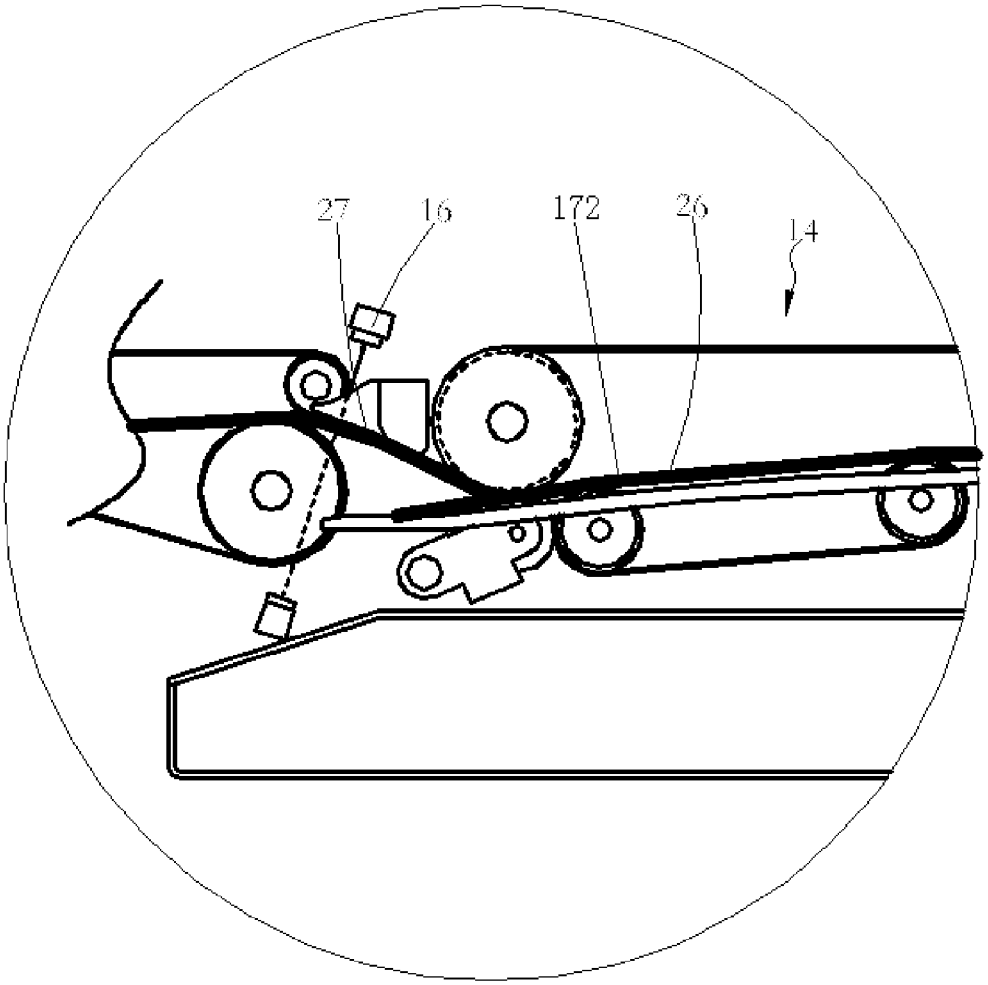
FIG. 13 is an enlarged diagram of Part A in FIG. 12.
Figure 14:
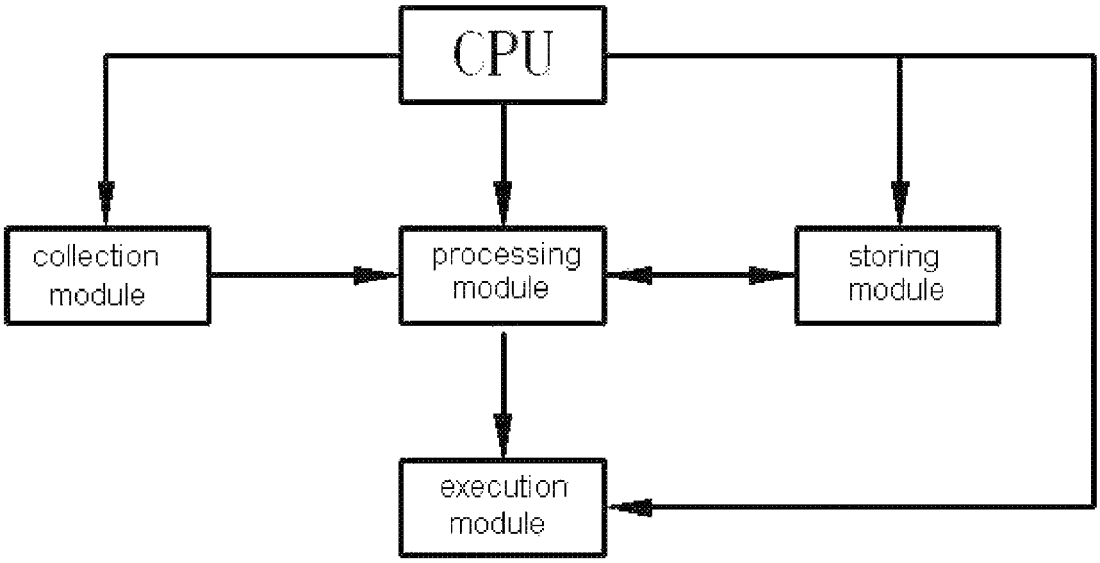
FIG. 14 is a schematic view of a control system of the paper-like medium stacking and recycling device according to the present application.

The operation process of the stacking and recycling device according to the present application is described hereinafter, on the basis of the detailed description of the structures of the stacking and recycling device according to the present application. Specifically, the operation process of the device is as follows:

as shown in FIG. 12 to FIG. 14 which show a returning and stacking process of the banknote. At this stage, the movable baffle 19 is in the closed state to block the advancing of the banknotes in the advancing direction. The banknote delivering floating bracket 219 is in the first position, thus the working surfaces of the upper segments of the second conveying belts 212 are lower than the upper arc surface of the front arc-shaped plate 18, and the banknote is not in contact with the working surfaces of the second conveying belts 212 where sliding along the arc-shaped plate. The direction switching device 24 is in the first position, thus the banknote can be smoothly conveyed along the arc surface. The upper convey-out conveying belt 11 and the lower convey-out conveying belt 12 convey the first banknote 26, the front end of the banknote is conveyed through the first sensor device (the collection module) 16, the sensor 16 feeds back information to a processing module of a control system, and then the processing module sends a signal after processing the information, to immediately activate a first driving motor (an execution module), or to activate the first driving motor after a period of time, such that the first conveying belt assembly, the second conveying belt assembly and the third conveying belt assembly rotate in the directions shown in FIG. 12. The banknote is conveyed forwardly under the cooperation of the first conveying belt assembly 14 and the back arc-shaped plate 17. Where the tail end of the banknote leaves the first sensor device 16, the first sensor device 16 feeds back information to the processing module of the control system, the processing module then sends a signal to stop the first driving motor after processing the information, thus the conveying belt assemblies are stopped, and the banknote is stopped at the position 172, with the tail portion of the banknote being exposed behind the first conveying belt assembly 14. The second banknote 27 is conveyed, the front end of the second banknote is conveyed through the first sensor device 16, and the first sensor device 16 feeds back information to the control system, the control system sends an activating signal to the first driving motor, to activate the first driving motor immediately, or to activate the first driving motor after a period of time, such that the first conveying belt assembly, the second conveying belt assembly and the third conveying belt assembly rotate in the directions shown in the Figures, then the front portion of the second banknote 27 is overlapped on the tail portion of the first banknote 26, and the first banknote and the second banknote partially overlapped are conveyed forward together by the first conveying belt assembly 114. Where the tail end of the second banknote leaves the first sensor device 16, corresponding information is fed back to the control system to stop the first driving motor, and then the second banknote is stopped at the position 172. A third banknote and subsequent banknotes are conveyed in the same way that the front portion of a latter banknote is overlapped on the back portion of a former banknote.

Figure 15:
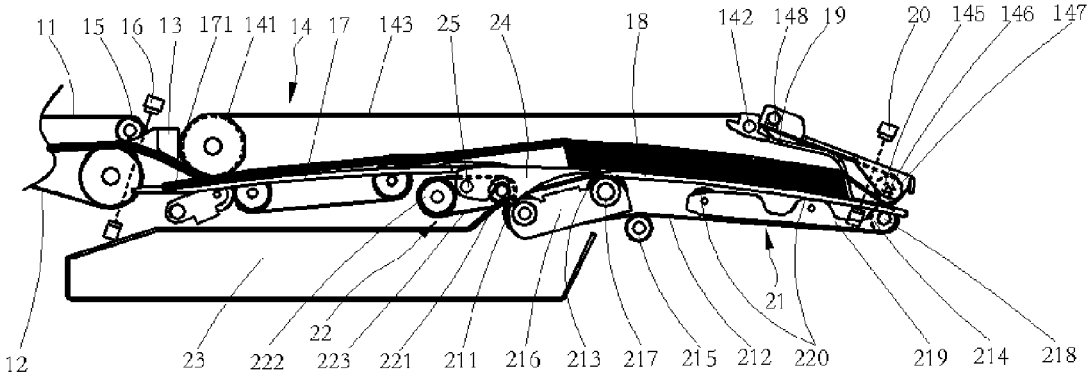
FIG. 15 is a schematic view of the paper-like medium stacking and recycling device according to the present application after the banknotes are aligned and stacked.

As shown in FIG. 15 which shows that the banknotes are conveyed by being overlapped with one another. Where the front end of the first banknote 26 is conveyed to the movable baffle 19, the banknote is blocked, and the first conveying belt 143 slides relative to the banknote. Since the force applied by the first conveying belt 143 to the banknote is larger than the frictions among the banknotes, the second banknote 27 is moved with respect to the first banknote 26 and is aligned with the first banknote 26 at the movable baffle 19. The third banknote and subsequent banknotes undergo the same process, until the front ends thereof are aligned at the movable baffle 19.

Figure 16:
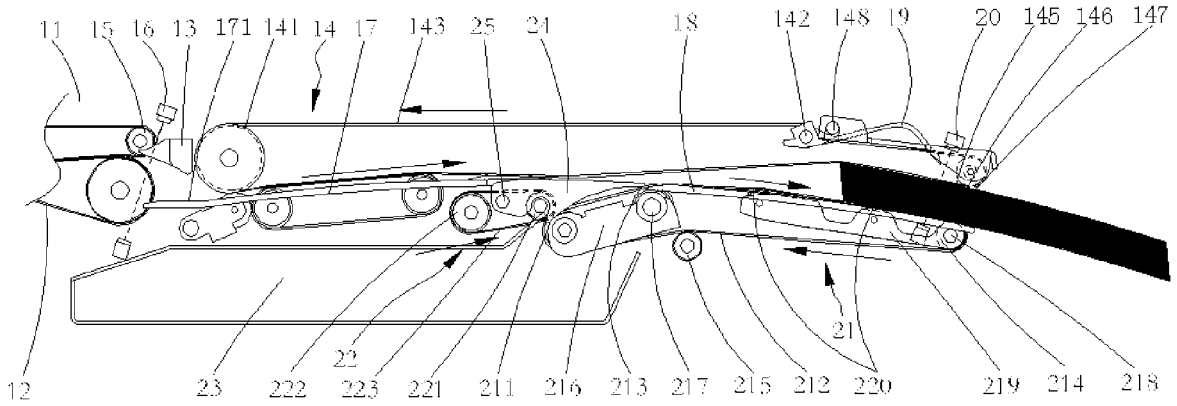
FIG. 16 is a schematic view of the paper-like medium stacking and recycling device according to the present application where delivering the stack of banknotes.

As shown in FIG. 16 which shows a process of delivering the whole stack of banknotes. After the processing of the banknotes is finished, the control system sends a signal to control the second motor to drive the movable baffle 19 such that the movable baffle 19 is in the opened state. Thereby the block in the advancing direction of the banknote is removed. Meanwhile, the delivering floating bracket 219 is switched to the second position, such that the working surfaces of the second conveying belts 212 are higher than the upper arc surface of the front arc-shaped plate 118, and the working surfaces of the second conveying belts 212 are in contact with the banknotes. The first driving motor is activated to drive the first conveying belt assembly, the second conveying belt assembly and the third conveying belt assembly to rotate in the directions shown in the Figure. The banknotes are clamped by the first conveying belt assembly 14 and the second conveying belt assembly 21 and are delivered outside. The pressing plate 147 can automatically adapt itself to the total thickness of the banknotes to adjust the interspace between the pressing roller 145 and the second pressing roller 214. Cooperated with the driving structures, and through the time controlling of the control program, after the banknotes are delivered outside to a certain distance, the conveying belts are stopped, and the pressing roller 145 and the second pressing roller 214 clamp the tail ends of the banknotes, thereby the delivering process is finished.

Figure 17:
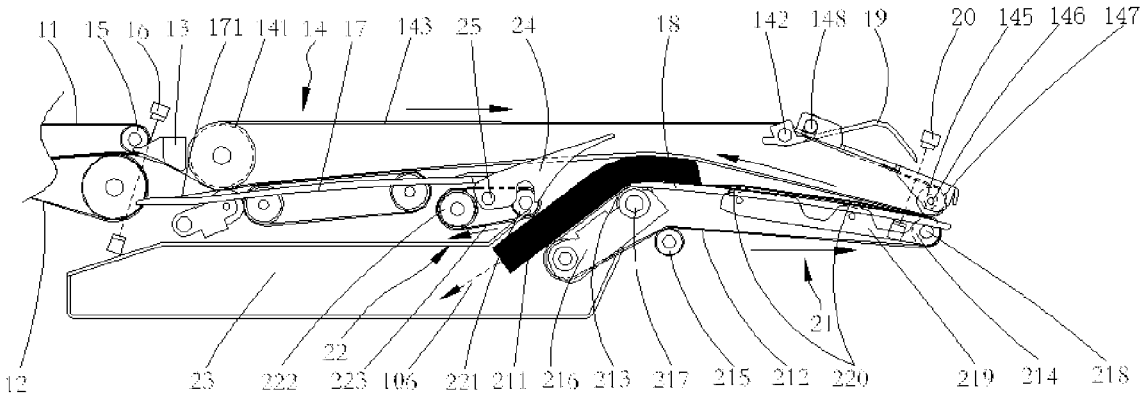
FIG. 17 is a schematic view showing the banknote recycling process of the device according to the present application in case that the user forgets to take away the banknotes.

As shown in FIG. 17 which shows a process for recycling the banknotes. After the banknotes are delivered outside, where it is determined that the returned banknotes or cheques are not took away by the user within the set time, the second sensor 20 (collection module) detects whether there exists any banknote: if the banknote exist, a signal is fed back to the control system, and the recycling process is triggered after the information is processed. At this time, the states of the movable baffle 19 and the delivering floating bracket 219 are not changed, while the direction switching device 24 is switched to the second position. The first driving motor rotates reversely, thereby driving the third conveying belt assembly 22 to rotate in the direction shown in the Figure. The whole stack of banknotes are clamped by the first conveying belt assembly 14 and the second conveying belt assembly 21 and are conveyed backward, and then are conveyed to the conveying port formed by the second conveying belt assembly 21 and the third conveying belt assembly 22 after the advancing direction is changed by the direction switching device 24. The recycling floating bracket 216 can automatically adapt itself to the total thickness of the banknotes to adjust the interspace between the driven rollers 221 and the recycling floating rollers 211, and the banknotes are conveyed, by the second conveying belt assembly 21 and the third conveying belt assembly 22, to the storing container 23 along the route 106, thereby the recycling process is finished.

By this way, the stacking and recycling device according to the present application has finished the following processes of the banknotes: aligning and stacking, delivering in a whole stack form, and recycling in a whole stack form, thereby during the recycling process of the banknotes, it does not need to perform another single-sheet separating process, nor does it need to convey the banknotes to the correcting mechanism, the paper identifying device, or the like, thus the possibility of machine failure is reduced.

The paper-like medium processing apparatus according to the present application is provided with the above stacking and recycling device 5, and the other components, for example, the single-sheet separating device 1, the paper correcting device 2, the paper identifying device 3, the temporary storing device 4 and the storing box 6, have similar structures to those of the prior art, and reference may be made to FIG. 1 and FIG. 2.

The above embodiments are only preferred embodiments of the present application. It should be noted that, the preferred embodiments should not be deemed to limit the present application, and the protection scope of the present application should be defined by the claims of the present application. Those skilled in the art may make improvements and modifications to the present application without departing from the spirits and scope of the present application, and the improvements and modifications should be deemed to fall into the protection scope of the present application.

What is claimed is:

1. A paper-like medium stacking and recycling device comprising:

a paper conveying and stacking mechanism located downstream of a paper discharging port and configured to convey discharged paper, one by one, to a predetermined position and stack the paper;

a paper delivering mechanism located at a downstream end of the paper conveying and stacking mechanism and configured to deliver the whole stack of paper outside; and a paper recycling mechanism located at a downstream end of a paper storing container and configured to recycle the whole stack of paper;

wherein the paper conveying and stacking mechanism comprises a first conveying belt assembly and a movable blocking mechanism, wherein a first conveying belt of the first conveying belt assembly is provided in parallel with a conveyed direction of the paper, the movable blocking mechanism is provided in the conveyed direction of the paper and can be closed during the stacking of the paper and be opened during the delivering of the paper, wherein the paper delivering mechanism comprises a second conveying belt assembly under the first conveying belt assembly, with a paper delivering outlet being formed between the downstream end of a second conveying belt of the second conveying belt assembly and a downstream end of the first conveying belt, wherein the paper recycling mechanism comprises a third conveying belt assembly located upstream of the second conveying belt assembly, with a paper recycling port corresponding to an inlet of the paper storing container being formed between a downstream end of a third conveying belt of the third conveying belt assembly and an upstream end of the second conveying belt, wherein a direction switching device is provided above the paper recycling port, the direction switching device being configured for closing the paper recycling port during the stacking and delivering of the paper and opening the paper recycling port during the recycling of the paper, and wherein the paper conveying and stacking mechanism comprises an arc-shaped plate located right under the first conveying belt, and a lower segment of the first conveying belt is tensioned and is in contact with the upper arc surface of the arc-shaped plate.

2. The paper-like medium stacking and recycling device according to claim 1, wherein the paper discharging port is formed by an upper convey-out conveying belt and a lower convey-out conveying belt, a guiding plate is provided downstream of the paper discharging port in an advancing direction of the paper, and the paper conveying and stacking mechanism is located downstream of the guiding plate.

3. The paper-like medium stacking and recycling device according to claim 1, wherein the arc-shaped plate includes a front arc-shaped plate and a back arc-shaped plate, wherein a curvature of the front arc-shaped plate is substantially equal to that of the back arc-shaped plate, and a surface at an upstream end of the back arc-shaped plate is lower than the paper discharging outlet.

4. The paper-like medium stacking and recycling device according to claim 3, wherein the paper recycling port is located under an interspace between the front arc-shaped plate and the back arc-shaped plate, and the direction switching device is pivotally mounted on a spindle which is located at a rear side of the paper recycling port.

5. The paper-like medium stacking and recycling device according to claim 4, wherein a top surface of the direction switching device is an arc surface having a curvature substantially equal to that of the front arc-shaped plate and that of the back arc-shaped plate, and the top surface of the direction switching device is continuous with an upper arc surface of the front arc-shaped plate and an upper arc surface of the back arc-shaped plate where the direction switching device is in a closed state closing the paper recycling port.

6. The paper-like medium stacking and recycling device according to claim 1, wherein a recycling floating mechanism is provided at the upstream end of the second conveying belt assembly, and the recycling floating mechanism comprises:

a recycling floating bracket which can swing about a recycling floating bracket spindle, and a recycling floating roller provided at a tail end of the recycling floating bracket, and the second conveying belt is engaged on the recycling floating roller.

7. The paper-like medium stacking and recycling device according to claim 1, wherein a delivering floating mechanism is provided at the downstream end of the second conveying belt assembly, wherein the delivering floating mechanism comprises:

a delivering floating bracket which can swing about a delivering floating bracket spindle, a delivering floating roller assembly provided on the delivering floating bracket, and the second conveying belt is engaged on the delivering floating roller assembly such that a working surface of the second conveying belt can be lower than the upper arc surface of the front arc-shaped plate during the stacking of the paper, and can be higher than the upper arc-shaped surface of the front arc-shaped plate during the delivering and recycling of the paper.

8. The paper-like medium stacking and recycling device according to claim 1, wherein a fourth conveying belt assembly is provided at the downstream end of the third conveying belt assembly, and an upper conveying surface of the fourth conveying belt assembly is partially in contact with a lower conveying surface of the first conveying belt assembly.

9. The paper-like medium stacking and recycling device according to claim 1, wherein a pressing plate which can swing about a pressing plate spindle is provided at the paper delivering outlet, a first pressing roller is provided on the pressing plate, and the first conveying belt is engaged on the first pressing roller.

10. The paper-like medium stacking and recycling device according to claim 9, wherein a second pressing roller is provided on the second conveying belt assembly at a position corresponding to the first pressing roller, and the second conveying belt is engaged on the second pressing roller.

11. The paper-like medium stacking and recycling device according to claim 1, wherein the movable blocking mechanism is a movable baffle located in the advancing direction of the paper and pivotally mounted on a movable baffle spindle.

12. The paper-like medium stacking and recycling device according to claim 1, comprising a control system which comprises:

a collection module comprising:

a first sensor device located between a convey-out roller at the paper discharging port and the driving roller of the first conveying belt assembly, for detecting paper condition to be conveyed to the upstream end of the first conveying belt assembly; and a second sensor device located downstream of the movable blocking mechanism, for detecting paper condition remained at the paper delivering outlet;

a processing module configured to receive a detection signal from the collection module, perform processing according to a preset strategy, and output a corresponding control signal; and an execution module configured to drive the first conveying belt assembly, the second conveying belt assembly, the third conveying belt assembly, the movable blocking mechanism and the direction switching device according to the corresponding control signal.

13. A paper-like medium processing apparatus comprising:

a single-sheet separating device, a paper correcting device, a paper identifying device, a temporary storing device, and a paper storing box, wherein the paper-like processing apparatus further comprises the paper-like stacking and recycling device according to claim 1 which is provided downstream of the temporary storing device.

14. The paper-like medium stacking and recycling device according to claim 13, wherein the paper discharging port is formed by an upper convey-out conveying belt and a lower convey-out conveying belt, a guiding plate is provided downstream of the paper discharging port in an advancing direction of the paper, and the paper conveying and stacking mechanism is located downstream of the guiding plate.

15. The paper-like medium processing apparatus according to claim 13, wherein the arc-shaped plate includes a front arc-shaped plate and a back arc-shaped plate, wherein a curvature of the front arc-shaped plate is substantially equal to that of the back arc-shaped plate, and a surface at an upstream end of the back arc-shaped plate is lower than the paper discharging outlet.

16. The paper-like medium processing apparatus according to claim 15, wherein the paper recycling port is located under an interspace between the front arc-shaped plate and the back arc-shaped plate, and the direction switching device is pivotally mounted on a spindle which is located at a rear side of the paper recycling port.

* * * * *